US008091606B2

(12) United States Patent
Nien et al.

(10) Patent No.: US 8,091,606 B2
(45) Date of Patent: Jan. 10, 2012

(54) OPERATING WAND FOR VENETIAN BLINDS

(75) Inventors: Ming Nien, Taichung (TW); Yu-Che Wen, Taoyuan (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 1916 days.

(21) Appl. No.: 10/925,725

(22) Filed: Aug. 25, 2004

(65) Prior Publication Data

US 2006/0042764 A1 Mar. 2, 2006

(51) Int. Cl.
*E06B 9/303* (2006.01)

(52) U.S. Cl. ..... 160/176.1 R; 16/429; 16/436; 15/144.1

(58) Field of Classification Search ..... 160/178.1 R, 160/176.1 R, 177 R; 15/144.1, 144.3; 16/429, 16/436, 352; 49/87.1
See application file for complete search history.

(56) References Cited

U.S. PATENT DOCUMENTS

| | | | | | |
|---|---|---|---|---|---|
| 1,643,281 | A | * | 9/1927 | Baumann et. al. | 160/300 |
| 3,633,646 | A | * | 1/1972 | Zilver | 160/168.1 R |
| 4,531,715 | A | | 7/1985 | Wiens | |
| 4,715,089 | A | | 12/1987 | Schema | |
| 4,759,398 | A | * | 7/1988 | Renee | 160/178.1 R |
| 5,186,229 | A | * | 2/1993 | Hsu | 160/176.1 R |
| 5,472,035 | A | | 12/1995 | Biba et al. | |
| 2,524,508 | A | | 6/1996 | Barnes | |
| 5,577,542 | A | | 11/1996 | Hung | |
| 5,645,685 | A | * | 7/1997 | Furhman | 160/168.1 R |
| 5,823,067 | A | * | 10/1998 | Clarys et al. | 74/546 |
| 5,845,695 | A | * | 12/1998 | Cadorette et al. | 160/173 |
| 5,918,657 | A | | 7/1999 | Tuzmen | |
| 6,032,321 | A | * | 3/2000 | Shirey et al. | 15/244.2 |
| 6,088,868 | A | * | 7/2000 | Cerveny | 15/144.3 |
| 6,089,303 | A | * | 7/2000 | Metcalf et al. | 160/176.1 R |
| 6,145,413 | A | | 11/2000 | Lin | |
| 6,298,897 | B1 | | 10/2001 | Metcalf et al. | |
| 6,651,721 | B2 | * | 11/2003 | Allsopp | 160/168.1 |
| 7,065,838 | B2 | * | 6/2006 | Mitchell et al. | 16/436 |
| 2004/0103995 | A1 | | 6/2004 | Nien | |

FOREIGN PATENT DOCUMENTS

| | | |
|---|---|---|
| EP | 0 898 043 A1 | 8/1998 |
| FR | 817.695 | 10/1937 |

* cited by examiner

*Primary Examiner* — Alivn Chin Shue
*Assistant Examiner* — Candace L Bradford
(74) *Attorney, Agent, or Firm* — Buchanan Ingersoll & Rooney PC

(57) ABSTRACT

An operating wand has a handle, an upper rod connected by an intermediate rod having one end pivotably attached to the upper end of the handle and the opposite end pivotably attached to the lower end of the upper rod. A sleeve slides along the upper rod between a first position and a second position. When in the first position the sleeve covers a portion of the upper rod, the handle, and the intermediate rod, keeping the handle, intermediate rod and upper rod in a co-linear alignment. When the sleeve is in the second position, the handle and intermediate rod are fully exposed allowing the intermediate rod to be moved relative to the handle and the upper rod so that the intermediate rod is normal to the handle and normal to the upper rod. With the sleeve in the second position the wand can be operated like a crank.

24 Claims, 4 Drawing Sheets

OPERATING WAND FOR VENETIAN BLINDS

FIELD OF INVENTION

The invention relates to venetian blinds and wands used to operate the tilt mechanism in a venetian blind.

BACKGROUND OF THE INVENTION

Venetian blinds are popular window coverings. This type of blind has a series of slats hung on ladders that extend between a headrail and a bottom rail. The slats can be tilted by moving the rungs of the ladders in opposite directions. Typically, the upper end of each ladder is attached to a drum. The drum for each ladder is on a common axle. Consequently, the slats can be tilted by turning the axle clockwise or counter clockwise. This drum and axle together with any gears that may be coupled to the axle is called the tilt mechanism or tilter.

The tilt mechanism could be operated by a motor but typically is manually controlled. One type of manual control is a cord loop that engages a wheel connected to the axle. A second manual control is a wand that is connected to the axle, typically by a universal joint and one or more gears. Because of child safety concerns, loop drive systems are disfavored. One could substitute two pull cords for the cord loop and some manufacturers have done this. But, a two pull cord system is more expensive and difficult to make than a cord loop. Of even more concern is that users tend to mistake the pull cords that operate the tilter for the lift cords that raise and lower the blinds. No such confusion occurs when a rod or wand is used to operate the tilter.

To operate a tilter using a wand, the operator must grasp the wand and rotate the wand about is longitudinal axis. Some people, particularly people who have arthritis in their hands, have difficulty grasping and rotating a rod. The art has developed a variety of wands which can be rotated by moving an outer sleeve up and down a central rod whose upper end is attached to the tilt mechanism. The central rod is threaded. Those threads engage threads on the inside of the sleeve. Consequently, movement of the sleeve along the rod will cause the rod to rotate. Examples of this type of tilt wand can be found in U.S. Pat. Nos. 6,089,303 and 6,298,897. One problem with this type of wand is that the sleeve must be moved up and down several times to move the slats from a closed position to an open position and from an open position to a closed position.

Some vertical venetian blinds have a single control which rotates the vanes and moves the vanes across the headrail. Commonly, this type of control has a cord loop. Pulling one side of the cord loop of an extended open blind with vanes perpendicular to the window initially rotates the vanes while continued pulling causes the vanes to move along the headrail. Pulling the opposite side of the loop initially rotates the vanes in an opposite direction. Continued pulling will move the vanes along the headrail in an opposite direction. This same action can be achieved in a horizontal blind using a control system in which the drums for the ladders and the spools on which lift cords are wound are all on a single axle. That axle is then operated by a cord loop as in the vertical blind. A wand or crank could be substituted for the cord loop. Because many rotations of the wand or crank are needed to raise the blind, a crank is much easier to operate than a wand.

Consequently, there is a need for an operating wand for a venetian blind tilt mechanism, or for a combination tilt and lift cord control device which is easy to operate by any user, even if the person has arthritis in his or her hand.

SUMMARY OF THE INVENTION

We provide an operating wand having a handle and an upper rod connected by an intermediate rod having one end pivotably attached to the upper end of the handle and the opposite end pivotably attached to the lower end of the upper rod. A sleeve slides along the upper rod between a first position to a second position. When in the first position the sleeve covers a portion of the upper rod, the handle, and the intermediate rod, keeping the handle, intermediate rod and upper rod in a co-linear alignment. When the sleeve is in the second position, the handle and intermediate rod are fully exposed allowing the intermediate rod to be moved relative to the handle and the upper rod so that the intermediate rod is normal to the handle and normal to the upper rod. The wand can be attached to the tilt mechanism, the lift mechanism or a combination tilt and lift mechanism of a venetian blind. When the wand is in the first position with the sleeve covering the handle and the intermediate rod, turning the sleeve will turn the upper rod. With the sleeve in the second position the wand can be operated like a crank.

In a present preferred embodiment the upper portion of the handle has a hex shaped portion that fits into a hex shaped bore in the sleeve when the sleeve covers the intermediate rod and handle. Consequently, when the sleeve is turned the entire wand will rotate in the same direction. The handle may be configured so that the sleeve will rest upon a shoulder at the base of the handle. In another embodiment the handle has a central rod extending from the hex portion and a sleeve that fits over the central rod and rotates freely around the rod.

Other objects and advantages of the present invention will become apparent from the detailed description of certain present preferred embodiments shown in the drawings.

DESCRIPTION OF THE PREFERRED EMBODIMENTS

Figure 1:
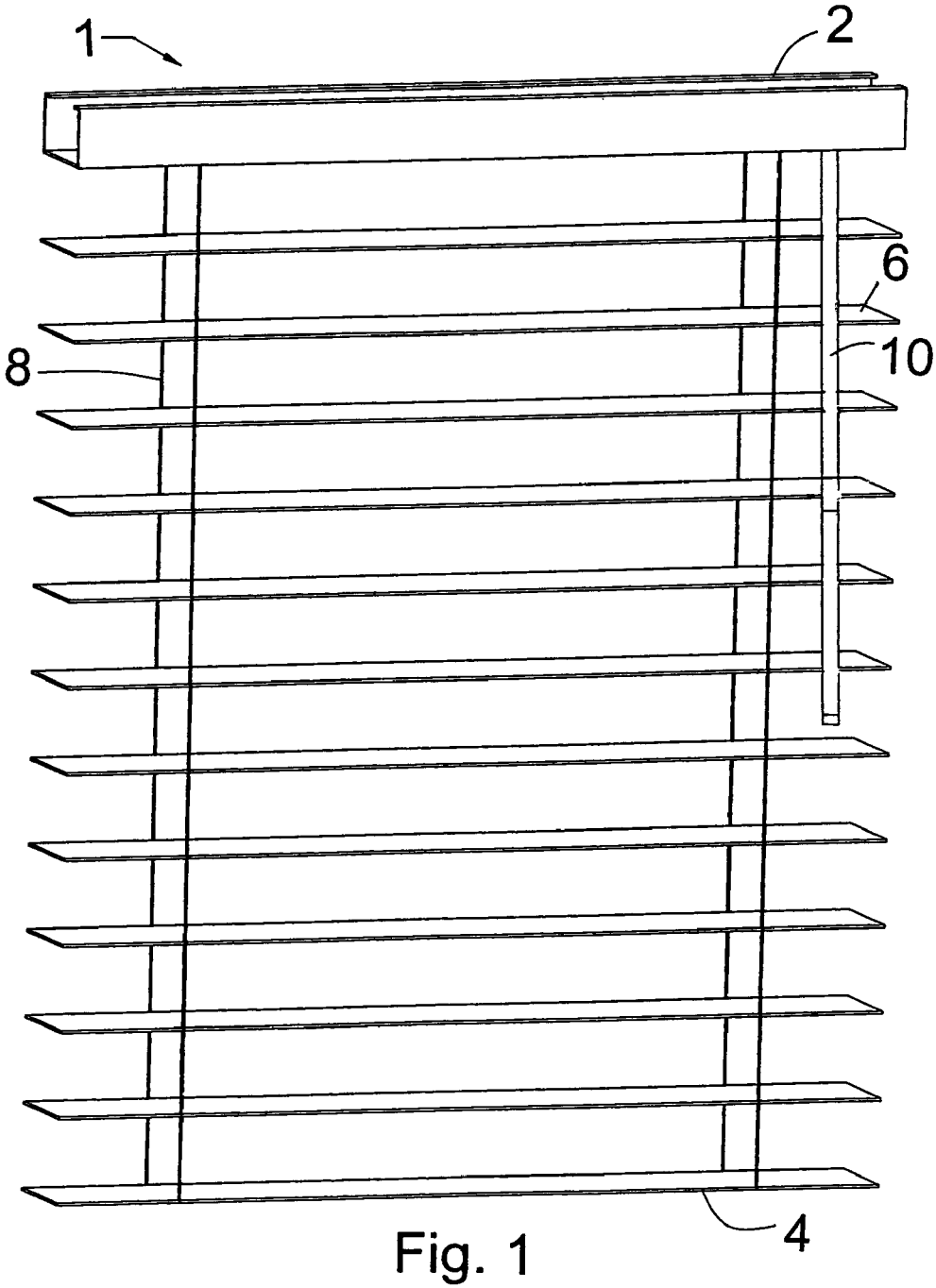
FIG. 1 is a perspective view of a venetian blind having an operating wand in accordance with the present invention.

A venetian blind 1 shown in FIG. 1, has a headrail 2, a bottomrail 4 and a series of slats or vanes 6 hung on ladders 8 extending between the headrail and the bottomrail. The upper ends of the ladders are connected to a tilt mechanism (not shown) within the headrail 2. The tilt mechanism alone may be operated by rotation of operating wand 10. In a present preferred venetian blind the drums to which the ladders are attached and the spools on which the lift cords are wound and unwound are on a common axle. Rotation of the wand in either direction initially tilts the slats while continued rotation raises or lowers the blind.

Figure 2:
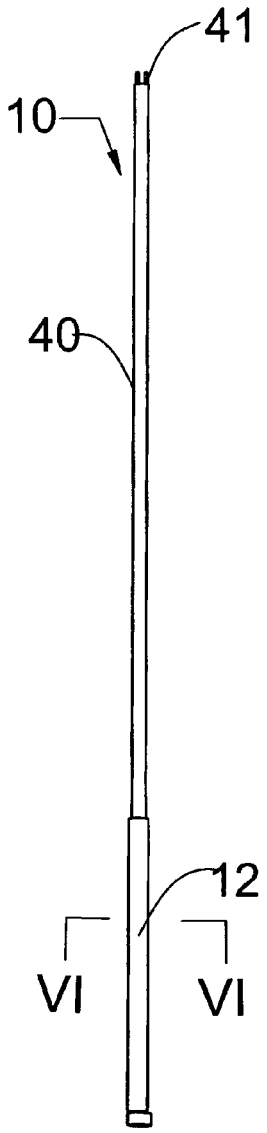
FIG. 2 is a perspective view of the operating wand in the venetian blind of claim 1 wherein the sleeve is in a first position.
Figure 4:
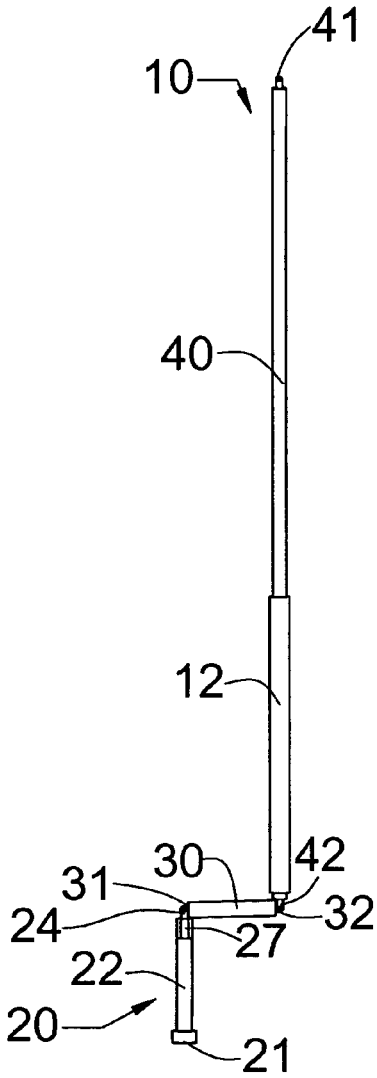
FIG. 4 is a perspective view similar to FIG. 3 wherein the handle of the operating wand is parallel to the upper rod portion of the operating wand and the wand is operable by a cranking motion.
Figure 5:
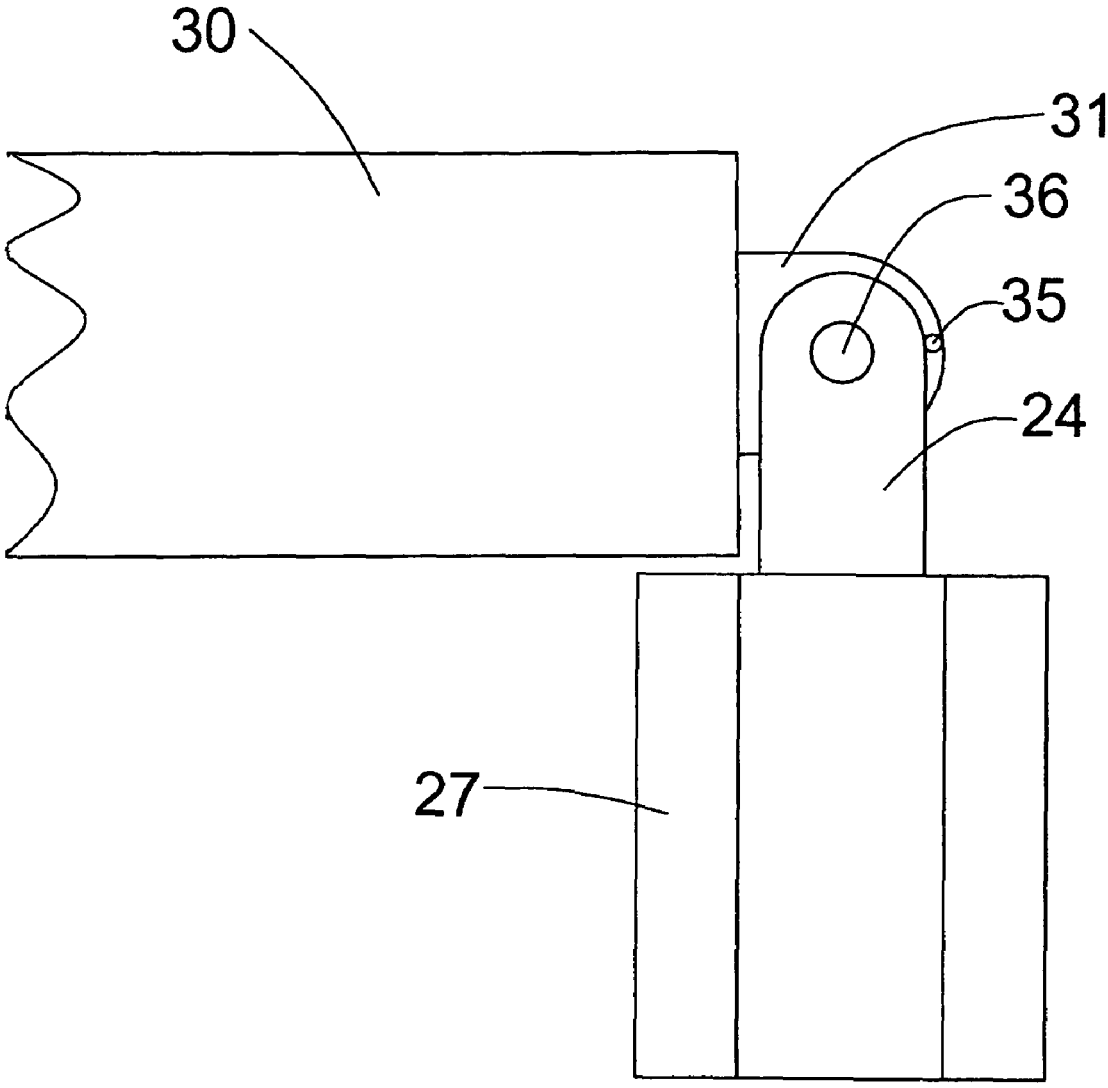
FIG. 5 is an enlarged view of the joint between the handle and the intermediate rod.

A present preferred operating wand 10 has two operating configurations. The first configuration is shown in FIGS. 1 and 2 and the second operating position is shown in FIG. 4. When the operating wand is in the first configuration of FIGS. 1 and 2 the rod is turned by grasping and rotating the interlocking sleeve 12 which is now located at the lower end of the operating wand 10. When the wand 10 is configured as in FIG. 4, the wand is turned using handle 20 as one would operate a crank. This cranking action is easier for people who suffer arthritis of the hand then rotating the wand as configured in FIGS. 1 and 2. But, the configuration in FIG. 4 is not as sleek as the configuration of FIGS. 1 and 2 and will more readily become caught in drapery or furniture that is near the blind. In those blinds where a single wand is used to control both tilt and lift cords, some customers may choose to use the configuration of FIG. 4 to raise and lower the blind because several rotations are required. Yet, those same customers may choose to use the configuration of FIGS. 1 and 2 to change the tilt of the slats or vanes because a partial turn or a few rotations is all that is needed to change the tilt of the slats to a desired position.

The present preferred construction of the operating wand 10 can be seen most clearly in FIGS. 3 through 6. A handle 20 has a cylindrical body 22 of a selected diameter with base 21 bottom portion 21 of slightly larger diameter which provides a shoulder 23. The upper end of the handle has a first clevis 24 whose base 27 is a hex nut. The bottom portion 21 may be attached to or formed as part of the handle 20. Arms define an opening which receives the first end 31 of the intermediate rod 30. Pin 36 secures the intermediate rod 30 to the first clevis 24 to provide a pivoting joint. One could use other structures for each pivoting joint, such as a hinge having two leaves and a pivot pin similar to a door hinge.

Upper rod 40 has a connector 41 at its upper end which engages a universal joint in the headrail. The lower end of the upper rod has a second clevis 42 which receives the second end 32 of the intermediate rod.

We prefer to provide a lock which will retain the intermediate rod in a position normal to the handle and normal to the upper rod as shown in FIG. 4. This lock could be a hemispherical projection 35 on each end of the intermediate rod which is adjacent the clevis arms when the operating wand is in the crank position shown in FIG. 5. Another possibility is to provide a slot (not shown) on the inside surface of one clevis arm which receives first end 31 of the intermediate rod when the intermediate rod is positioned as in FIGS. 4 and 5. A spring provided between the opposite arm of the clevis and the end of the intermediate rod would push the end into the slot. Yet another type of lock could be mating crown gears on the inside surface and the end of a clevis arm of the intermediate rod. Other locking structures known in the art could also be used.

In the operating configuration shown in FIG. 4, the intermediate rod is at right angles to the upper end and the handle. Although this is the preferred angle other angles less than 90°, such as 45°, could be provided. Moreover, the two angles may be different. Such other angles can be chosen so that the upper rod, intermediate rod and handle will not be co-linear and the operating wand can be operated as a crank.

Figure 3:
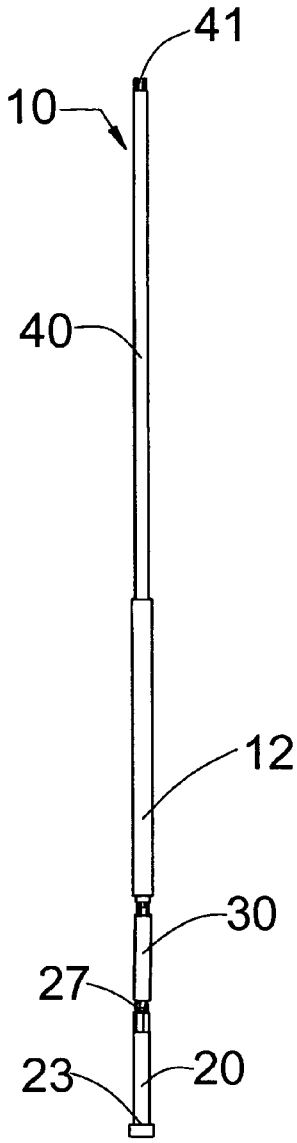
FIG. 3 is a perspective view similar to FIG. 2 wherein the sleeve has been raised to a second position.
Figure 6:
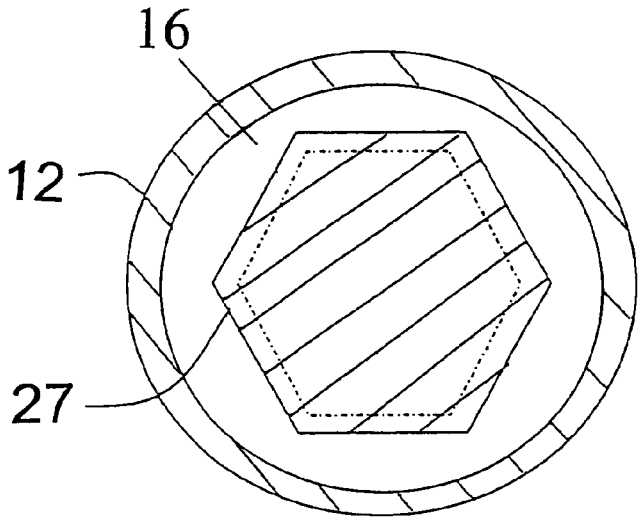
FIG. 6 is a sectional view taken along the line VI-VI in FIG. 2.

When the upper rod 40, intermediate rod 30 and handle 20 are co-linear as in FIGS. 1, 2 and 3, and hanging from a blind, interlocking sleeve 12 rests on the shoulder 23. The sleeve covers the handle, intermediate rod and a portion of the upper rod. A portion of interlocking sleeve 12 will encircle the base 27. As can be seen in FIG. 6, the bore 16 of that portion of the sleeve has a hexagon cross-section so that the sleeve engages the base 27. Consequently, rotation of the sleeve in either direction will rotate the handle 20, intermediate rod 30 and upper rod 40 in the same direction. While we prefer that the shape of the base 27 and bore 16 be a hexagon, the cross-section could be any noncircular shape including any polygon as well as an oval. Of course, polygon cross-sections with more than eight sides are more likely to slip than those with fewer sides. If desired, bore 16 could be configured to provide a shoulder which rests on the base 27 when the sleeve is positioned as in FIGS. 1 and 2. In that event, the sleeve may not rest on shoulder 23 of handle 20.

Figure 7:
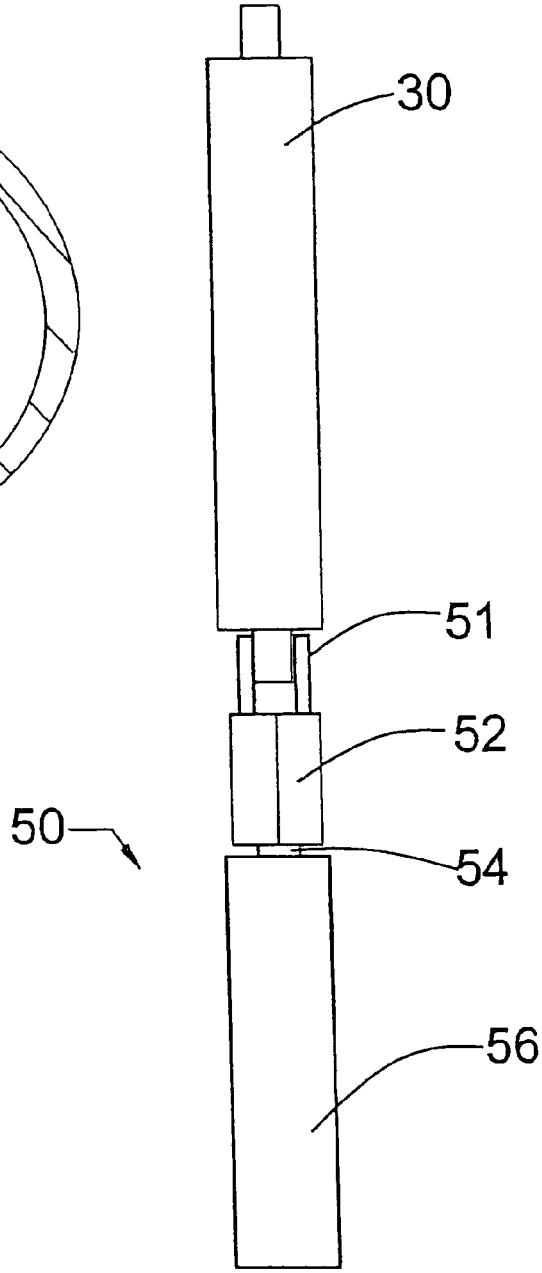
FIG. 7 is a perspective view of a second present preferred handle that can be used in the operating wand of the present invention.

If the interlocking sleeve 12 is designed to rest on the base 27 rather than a shoulder 23 near the base of the handle, one could use the handle shown in FIG. 7. This handle 50 has a similar clevis 51 with a hex base 52. A cylindrical shaft 54 extends from the hex base 52. A mating sleeve 56 is provided on the cylindrical shaft 54 and is free to rotate around the shaft.

The operating wand 10 could be made of metal or plastic. In a present preferred embodiment, the sleeve is plastic and the remaining parts are metal. We prefer to make the upper rod of aluminum, while the intermediate rod and handle are stainless steel. Each of the upper rod, intermediate rod and handle could be multi-piece structures. Indeed, the upper rod could be configured to separate in the middle to allow insertion of an extension segment to length the upper rod. Or, the rod could be configured to enable attachment of an extension segment to either end. Additionally, the upper rod could be a telescoping rod.

Although we have described and illustrated the operating wand in combination with a venetian blind, its use is not so limited. The operating wand could be used for awnings, skylights, and any other device which is manually operated by rotation of a rod that extends beyond the reach of the user.

While we have described and illustrated certain present preferred embodiments of our operating wand alone and in combination with a venetian blind, it is to be distinctly understood that our invention is not so limited and may be variously embodied within the scope of the following claims.

We claim:

1. An operating wand comprising:

a handle having an upper end and a lower end, a portion of the handle having a non-circular cross-section;

an upper rod having an upper end and a lower end;

an intermediate rod having a first end and a second end, the first end pivotably attached to the upper end of the handle and the second end pivotably attached to the lower end of the upper rod; and a sleeve on at least a portion of the upper rod, the sleeve sized to cover the handle, intermediate rod and a lower portion of the upper rod, keeping the handle, intermediate rod and upper rod in a co-linear alignment when the sleeve is in a first position, the sleeve capable of being slid up the upper rod to a second position allowing the intermediate rod to be moved relative to the handle and the upper rod so that the intermediate rod is not co-linear with the handle and not co-linear with the upper rod, and the sleeve also having a bore, the bore having a mating portion, the mating portion having a non-circular cross-section configured to mate with the portion of the handle having a non-circular cross-section such that when the mating portion of the bore is aligned with that portion of the handle, rotation of the sleeve will rotate the handle.

2. The wand of claim 1 wherein the intermediate rod is attached to the handle by a first clevis and the intermediate rod is attached to the upper rod by a second clevis.

3. The wand of claim 1 wherein the non-circular cross-section of the portion of the handle is a polygon.

4. The wand of claim 3 wherein the polygon is a hexagon.

5. The wand of claim 1 also comprising a first lock member at the first end of the intermediate rod, the first lock member retaining the intermediate rod in a position normal to the handle when the lock mechanism is engaged.

6. The wand of claim 1 also comprising a second lock member at the second end of the intermediate rod, the lock member retaining the intermediate rod in a position normal to the upper rod when the second lock member is engaged.

7. The wand of claim 1 wherein the handle, intermediate rod, upper rod and sleeve are metal or plastic.

8. The wand of claim 1 also comprising a hemispherical projection on at least one of the first end and the second end of the intermediate rod.

9. The wand of claim 1 also comprising a connector attached to the upper end of the upper rod.

10. The wand of claim 1 wherein the intermediate rod can be moved to a position normal to the handle and normal to the upper rod when the sleeve is in the second position.

11. A blind having a plurality of vanes or slats manually operated by a tilt mechanism wherein the improvement comprising an operating wand connected to the tilt mechanism, the operating wand comprising:

a handle having an upper end and a lower end, a portion of the handle having a non-circular cross-section;

an upper rod having an upper end and a lower end;

an intermediate rod having a first end and a second end, the first end pivotably attached to the upper end of the handle and the second end pivotably attached to the lower end of the upper rod; and a sleeve on at least a portion of the upper rod, the sleeve sized to cover the handle, intermediate rod and a lower portion of the upper rod, keeping the handle, intermediate rod and upper rod in a co-linear alignment when the sleeve is in a first position, the sleeve capable of being slid up the upper rod to a second position allowing the intermediate rod to be moved relative to the handle and the upper rod so that the intermediate rod is not co-linear with the handle and not co-linear with the upper rod, and the sleeve also having a bore, the bore having a mating portion, the mating portion having a non-circular cross-section configured to mate with the portion of the handle having a non-circular cross-section such that when the mating portion of the bore is aligned with the portion of the handle, rotation of the sleeve will rotate the handle.

12. The blind of claim 11 wherein the intermediate rod is attached to the handle by a first clevis and the intermediate rod is attached to the upper rod by a second clevis.

13. The blind of claim 11 wherein the non-circular cross-section of the portion of the handle is a polygon.

14. The blind of claim 13 wherein the polygon is a hexagon.

15. The blind of claim 11 also comprising a first lock member at the first end of the intermediate rod, the lock member retaining the intermediate rod in a position normal to the handle when the lock mechanism is engaged.

16. The blind of claim 11 also comprising a second lock member at the second end of the intermediate rod, the lock member retaining the intermediate rod in a position normal to the upper rod when the lock member is engaged.

17. The blind of claim 11 wherein the handle, intermediate rod, upper rod and sleeve are metal or plastic.

18. The blind of claim 11 also comprising a hemispherical projection on at least one of the first end and the second end of the intermediate rod.

19. The blind of claim 11 also comprising a hook attached to the upper end of the upper rod.

20. The blind of claim 11 wherein the blind is configured so that rotation of the wand controls tilt and operates tilt cords.

21. The blind of claim 11 wherein the blind is a venetian blind.

22. The blind of claim 11 wherein the blind is a vertical blind.

23. The blind of claim 11 wherein the intermediate rod can be moved to a position normal to the handle and normal to the upper rod when the sleeve is in the second position.

24. An operating wand comprising:

a handle having an upper end and a lower end, a portion of the handle having a non-circular cross-section;

an upper rod having an upper end and a lower end; and a sleeve on at least a portion of the upper rod, the sleeve sized to cover the handle, and a lower portion of the upper rod, keeping the handle and upper rod in a co-linear alignment when the sleeve is in a first position, the sleeve capable of being slid up the upper rod to a second position allowing the handle to be moved relative to the upper rod so that the handle is not co-linear with the upper rod, and the sleeve also having a bore, the bore having a mating portion, the mating portion having a non-circular cross-section configured to mate with the portion of the handle having a non-circular cross-section such that when the mating portion of the bore is aligned with that portion of the handle, rotation of the sleeve will rotate the handle.

* * * * *